United States Patent [19]

Mitchell

[11] Patent Number: 4,738,404

[45] Date of Patent: Apr. 19, 1988

[54] ROTARY KNIFE CUTTER HAVING ROLL-OFF COVER

[75] Inventor: Wayne R. Mitchell, Muncy, Pa.

[73] Assignee: Sprout-Bauer, Inc., Muncy, Pa.

[21] Appl. No.: 10,048

[22] Filed: Feb. 2, 1987

[51] Int. Cl.[4] ..... B02C 18/16

[52] U.S. Cl. ..... 241/285 A

[58] Field of Search ..... 241/285 R, 73, 285 A, 241/285 B, 189 R, 242, 224

[56] References Cited

U.S. PATENT DOCUMENTS 4,200,243 4/1980 Peterson, Jr. ..... 241/285 A X 4,261,523 4/1981 LaPointe ..... 241/285 A X

FOREIGN PATENT DOCUMENTS 835487 6/1981 U.S.S.R. ..... 241/285 A

*Primary Examiner*—Mark Rosenbaum

*Attorney, Agent, or Firm*—William W. Habelt

[57] ABSTRACT

A rotary cutter comprises a housing having a base portion, a cover portion, and a working chamber defined therebetween. The cover portion has laterally extending side flanges adapted to mate and bolt to the upper surface of the base portion. A generally cylindrical rotor having a plurality of knives mounted about its periphery is mounted to a shaft horizontally disposed within the working chamber and adapted for rotation about its longitudinal axis. An inlet feed tube is mounted to the cover portion of the housing for feeding a material to be shredded into the working chamber. Camrolls are mounted to the four corners cover of the housing along the lateral side flanges thereof for translating the cover portion of the housing parallel to the longitudinal axis of the rotor along track means associated with the base portion of the housing along which the top portion of the housing may be translated on the camroll means. The track means has a first track portion comprising the lateral extending flat upper surface on each side of the base portion of the housing and a second track portion comprising a pair of lateral spaced rails extending axially outward from the end of the base portion of the housing. The rails are positioned to receive the cover portion of the housing when the cover portion has been translated axially along the first track portion of the track means thereby opening the working chamber to expose and provide access to the horizontal rotor.

4 Claims, 3 Drawing Sheets

ROTARY KNIFE CUTTER HAVING ROLL-OFF COVER

BACKGROUND OF THE INVENTION

The present invention relates in general to an improvement in cover design for any machine having a horizontal rotor access to which is gained by removal of the cover and, more particularly, to an improved rotary knife cutter provided with a roll-off cover which may be readily translated to facilitate access to the cutter rotor for cleaning and maintenance.

Rotary knife cutters find very diversified application in industry for producing geometrically shaped particle sizes of any material that can be reduced by cutting or shearing action. One particular use of rotary knife cutter is for precise shearing of plastic film scrap such as pieces of polyethylene, polypropylene, or polyester films as thin as ½ mil and as heavy as 10 mil. It is customary in industry to recycle scrap plastic film that comes from trimming the edges of the rolls to provide a uniform edge on the film being manufactured, or from film that is defective in that it is off-spec in thickness or has impurities or holes. Typically, this scrap is passed through the rotary knife cutter and cut into fine pieces particles which are then mixed with virgin pellets, remelted and extruded to produce new film.

During the manufacturing process, it is often necessary to open the rotary knife cutter and clean any film particles that may have accumulated in cracks or crevices within the working chamber of the cutter housing prior to changing plastic composition or color to prevent contamination of the new batch when recycling the scrap material. Therefore, it is highly advantageous to manufacturers to have a method of very quickly opening the top of the rotary cutter housing to gain access to the rotary cutting knife for cleaning purposes. It is the present customary practice in the industry to provide rotary knife cutters which have covers hinged to the housing so that they may be lifted with a hydraulic cylinder, or which are merely bolted to the housing and removed by lifting with an overhead hoist after unbolting from the machine base. Unfortunately, such a process can be laborious and timeconsuming in that in commonly takes two men from one to six hours, depending upon the machine design and location, to open a prior art rotary knife cutter for cleaning or service.

SUMMARY OF THE INVENTION

It is an object of the present invention to provide a machine having a horizontal rotor disposed within a working chamber defined by the machine housing wherein the top portion of the machine housing is translatable so as to expose the horizontal rotor for service and maintenance work.

It is a further object of the present invention to provide an improved rotary cutting apparatus wherein the knife rotor horizontally disposed within the working chamber defined within the cutter housing is accessible by translation of the top portion of the cutter housing axially along the rotor axis.

The improved rotary cutting apparatus comprises a housing having a base portion and a cover portion disposed above the base portion so as to define a working chamber therebetween. The cover portion has laterally extending side flanges adapted to mate and bolt to the upper surface of the base portion. A generally cyclindrical rotor is mounted to a shaft horizontally disposed within the working chamber and adapted for rotation about its longitudinal axis. At least one knife, and preferably a plurality thereof, are fixed peripherally to the rotor. Inlet means, such as an inlet feed tube, is mounted to the cover portion of the housing for feeding a material to be shredded into the working chamber.

The improvement of the present invention in such a rotary cutting apparatus or other machine having a horizontally disposed rotor within its working chamber comprises a plurality of camroll means mounted to the cover of the housing along the lateral side flanges thereof for translating the cover portion of the housing parallel to the longitudinal axis of the rotor, and track means associated with the base portion of the housing along which the top portion of the housing may be translated on the camroll means. The track means has a first track portion comprising the lateral extending flat upper surface on each side of the base portion of the housing and a second track portion comprising a pair of lateral spaced rails extending axially outward from an end of the base portion of the housing. The rails are positioned to receive the cover portion of the housing when the cover portion has been translated axially along the first track portion of the track means off the end of the base portion thereby opening the working chamber to expose and provide access to the horizontal rotor.

Preferably, the second track means comprises a pair of laterally spaced rails which are interconnected by a support member extending transversely therebetween and which are hinged to the end of the base portion of the housing. The rails are hinged to the base portion of the housing so as to be selectively positionable from a first position extending substantially vertically downward along the end of the base portion of the housing to a second position extending axially outwardly from the end of the base portion of the housing whereby the rails form an extension of the flat upper surfaces at the sides of the base portion of the housing. Locking means operatively associated with the second track portion are provided for locking the spaced rails in their second position when the locking means is engaged.

The camroll means comprises in combination a roller shaft, a roller bearing, a block, an eccentric cam bushing, and stop means. The block is disposed about the rotor shaft and mounted to the cover portion of the housing such as by welding the base of the block to the top surface of the laterally extending side flange of the cover portion of the housing. The roller shaft extends axially through the block such that the block is disposed eccentrically about the roller shaft. A roller bearing is disposed axially outwardly of the block and coaxially about the roller shaft so as to freely rotate about the roller shaft. An eccentric cam bushing is mounted about the roller shaft intermediate the roller shaft and the block disposed eccentrically about the roller shaft. Rotation of the cam bushing upon rotation of the roller shaft raises or lowers, depending upon direction of rotation of the shaft, the cover portion of the housing relative to the base portion of the housing. Stop means are mounted to the roller shaft axially inward of the block for limiting the rotation of the roller shaft such that the cover portion of the housing may be raised above the base portion of the housing a desired distance and held in that position during translation of the cover portion from the base portion axially along the axis of the cutting rotor.

DETAILED DESCRIPTION OF A PREFERRED EMBODIMENT

Figure 1:
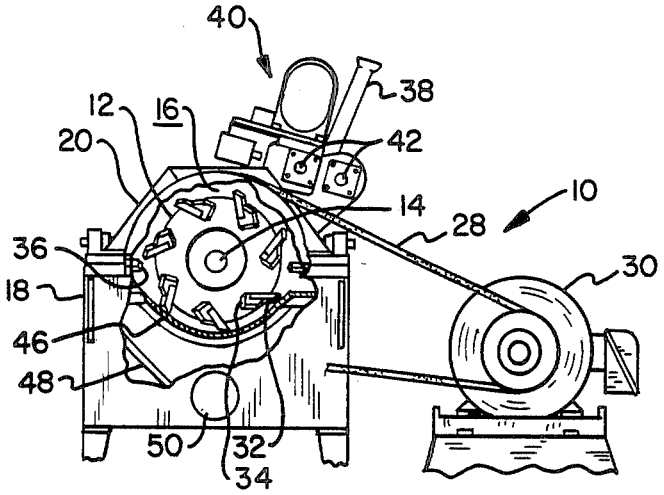
FIG. 1 is an end elevational view, partly in section, showing a rotary cutting apparatus designed in accordance with the present invention.

Referring now to the drawings, and more particularly to FIGS. 1, 2, 3 and 4 thereof, there is depicted therein a rotary cutting apparatus 10 which includes a generally cylindrical rotor 12 mounted to a shaft 14 which extends horizontally through the working chamber 16 defined between the base portion 18 of the cutter housing and the cover portion 20 of the cutter housing disposed thereabove. The rotor shaft 14 extends horizontally through the working chamber 16 and is mounted at its one end to a bearing 22, while at its opposite end it passes through bearing bushing 24 and is mounted to flywheel 26. The flywheel 26 is driven in a conventional manner by motor 30 through drive belt 28. As the flywheel 26 rotates, the shaft 14 mounted thereto in turn rotates and the cylindrical rotor 12 mounted to the rotor shaft 14 also rotates within the working chamber 16.

As best seen in FIG. 1, a plurality of knives 32 are mounted to the rotor 12 at spaced intervals around its periphery. Each of the knives 32 is keyed into a pocket formed in the rotor surface. Each of the knives 32 are held in their pocket by means of a wedge 34 which is driven into the pocket once the knife has been placed in proper position. As the rotor 12 rotates about the longitudinal axis of the rotor shaft 14, the rotor knives 32 engage in a cooperative cutting relationship a pair of bed knives 36 which are generally disposed diametrically opposite each other along the horizontal plane through the longitudinal axis of the rotor 12.

Materials, such as plastic films, which are to be shredded and reduced to a particular particle size are introduced into the working chamber 16 through inlet tube 38 of feeder 40 which is typically mounted to one side of the cover portion 20 of the cutter housing. Typically, the feeder 40 includes feed rolls 42 which are generally driven by a variable speed motor 44 to ensure positive feed of material through the inlet tube 38 to the working chamber 16.

As the rotor 12 rotates with the rotor shaft 14 about its longitudinal axis, the material fed to the working chamber 16 through the inlet feed tube 38 passes between the stationary bed knives 36 and the rotating rotor knives 32 and the cut or shredded so as to reduce its size. Material which has been sufficiently reduced in size passes through a concave screen 46 disposed below the cutting chamber 16. The concave screen 46 is provided with holes which are sized to pass only material which has been reduced to the proper size. The reduced material which passes through the concave screen 46 is received on a generally concave, inclined cradle 48 positioned below the screen for receiving and collecting the reduced material. The material collected on the cradle 48 slides downwardly along the cradles' inclined surface and is removed through outlet chute 50 to be utilized for recycle.

As mentioned hereinbefore, it is often necessary to access the horizontally disposed rotor 12 of the cutting apparatus 10 for cleaning and maintenance. The present invention provides an improved arrangement for accessing the cutting chamber 16 for cleaning and servicing the cylindrical rotor 12 of the cutting apparatus 10 by providing an improved cover portion 20 for the cutter housing which is adapted to be translatable along the longitudinal axis of the rotor shaft 14 on track means associated with the base portion 18 of the cutter housing such that the cover portion 20 may be translated sufficiently off the base portion 18 of the cutter housing to fully expose the cylindrical rotor 12 disposed within the working chamber 16 of the rotary cutting apparatus 10.

The base portion 18 of the cutter housing is provided with a laterally extending flat upper surface on each of its longitudinal sides. Additionally, a pair of laterally spaced rails 54 are provided to extend axially outwardly from the end of the base portion 20 of the cutter housing so as to be positioned to receive the cover portion 20 of the cutter housing when the cover portion 20 has been translated off the base portion 18 of the cutter housing. In combination, the laterally extending flat upper surfaces 52 of the base portion 18 of the cutter housing and the laterally spaced rails 54 extending outwardly from the end of the base portion 18 of the cutter housing form track means 56 along which the cover portion 20 of the cutter housing may be translated axially along the longitudinal axis of the rotor shaft 14 so as to open the working chamber 18 of the rotary cutting apparatus 10 for access to service the rotor 12 horizontally disposed within the working chamber. The laterally extending flat upper surfaces 52 of the base portion 18 of the cutter housing comprise a first portion of the track means 56 and the pair of laterally spaced rails 54 comprise a second track portion of the track means 56 which extends axially outwardly beyond the base portion 18 of the cutter housing.

Figure 3:
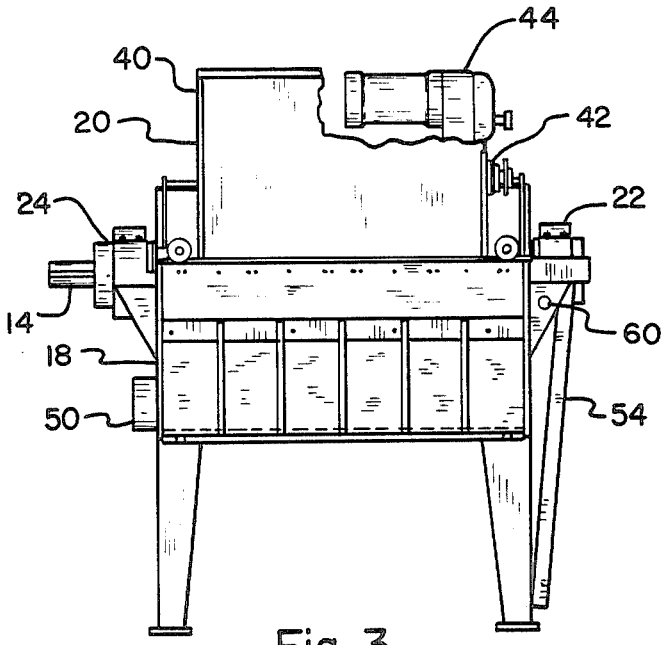
FIG. 3 is a side elevational view showing a rotary cutting apparatus designed in accordance with the present invention with the extension portion of the track means in its non-engaged position.
Figure 4:
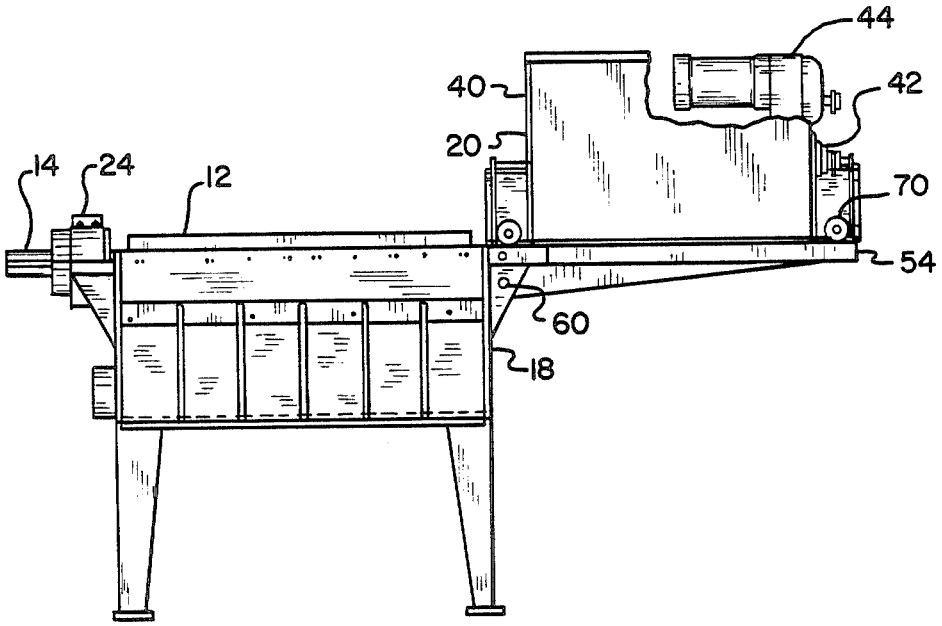
FIG. 4 is a side elevational view showing a rotary cutting apparatus designed in accordance with the present invention with the extended track means engaged.

Preferably, the second track portion of the track means 56 comprises a pair of laterally spaced rails 54 interconnected by a support member 58 extending transversely therebetween and hinged to the end of the base portion 18 of the cutter housing through hinge pin means 60. In this manner, the second track portion of the track means 56, i.e. the laterally spaced rails 54, are selectively positionable from a first position extending substantially vertically downward along the end of the base portion 18 of the cutter housing adajcent the hinge pin means 60 as shown in FIG. 3 to a second position extending axially outwardly from the end of the base portion 18 of the cutter housing as shown in FIG. 4 whereby the rails form an extension of the flat upper surfaces 52 at the sides of the base portion 18 of the cutter housing. Locking means 62, such as a self-locking pin, are provided in operative association with the second track portion of the track means 56 for locking the laterally spaced rails 54 in their second position when the locking means is engaged between the second track portion of the track means 56 and the base portion 18 of the cutter housing.

Figure 2:
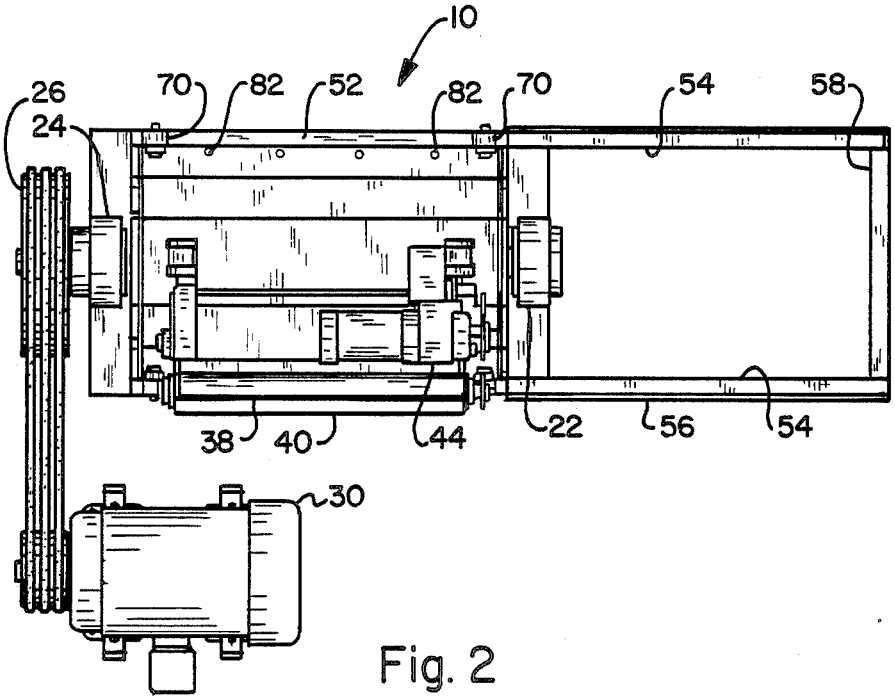
FIG. 2 is a plan view of the rotary cutting apparatus of FIG. 1.

The cover portion 20 of the cutter housing is provided with laterally extending side flanges 70 adapted to mate with and sit upon the base portion 18 of the cutter housing laterally adjacent and inwardly of the laterally extending flat upper surfaces 52 of the base portion 18 of the cutter housing which form the first portion of the track means 56. A plurality of camroll means 70 are mounted to the cover portion 20 of the cutter housing along the lateral side flanges 70 thereof for raising the cover portion 20 of the cutter housing off the base portion of the cover housing and translating the raised cover portion 20 of the cutter housing parallel to the longitudinal axis of the rotor 12 along the track means 56. Preferably, a plurality of four camroll means 70 are mounted to the cover portion 18 of the cutter housing with one camroll means 70 mounted to the laterally extending side flanges 70 at each corner of the cover portion as best seen in FIG. 2.

Figure 5:
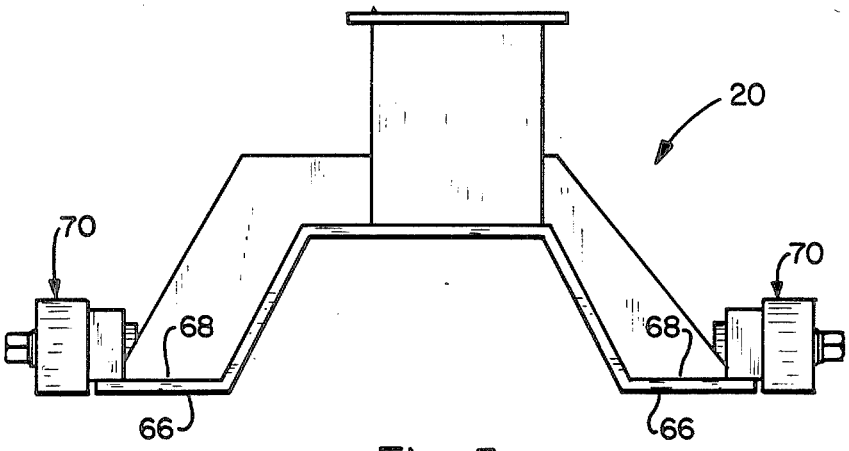
FIG. 5 is an enlarged end view showing the cover portion of the housing of the apparatus designed in accordance with the present invention.
Figure 6A:
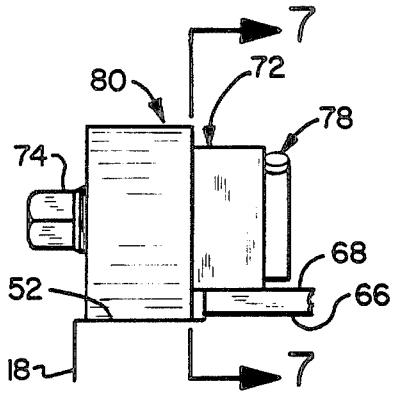
FIG. 6A is an enlarged end view of the camroll means of the present invention with the cover portion of the housing resting on the base portion of the housing.
Figure 7:
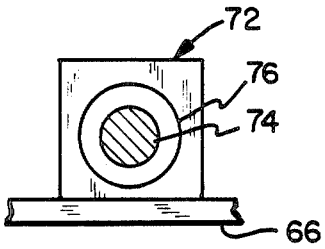
FIG. 7 is a sectional view taken along line 7—7 of FIG. 6A.
Figure 6B:
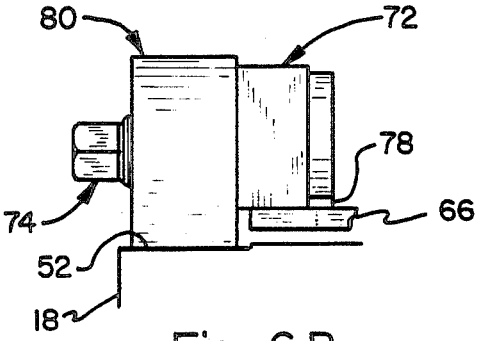
FIG. 6B is an end view of the camroll means of the present invention with the shaft having been rotated so as to raise the cover portion of the housing from the base portion of the housing.

As best seen in FIGS. 5, 6 and 7, each of the camroll means 70 comprises a block 72, a cam shaft 74, an eccentric cam bushing 76, stop means 78, and a roller bearing 80. The block 72 is mounted, such as by welding, to the upper surface 68 of the laterally extending side flanges 66 of the cover portion 20 of the cutter housing. The cam shaft 74 extends axially through the block 72 with the block 72 disposed eccentrically about the cam shaft 74. An eccentric cam bushing 76 is mounted to the cam shaft at a position on the cam shaft intermediate the cam shaft and the block 72 disposed eccentrically about the cam shaft as best seen in FIG. 7. Upon rotation of the cam shaft bushing 76 with rotation of the cam shaft 74 the cover portion 20 of the cutter housing may be lowered onto the base portion 18 of the cutter housing as shown in FIG. 6A, or raised off the base portion 18 thereof as shown in FIG. 6B, depending upon the direction of rotation. Stop means 78 is mounted to the cam shaft 74 axially inwardly of the block 72 for limiting the rotation of the cam shaft 74 so that the cam will not pass over center position. If the cam shaft were to pass over center position, the cover portion 20 would not be held off the base portion 18 of the cutter housing but would, due to its weight and its inertia, continue to cause the shaft to rotate and the cover to fall back upon the base portion of the housing.

The roller bearing 80 is disposed about the cam shaft 74 axially outwardly of the block 72 so as to rest upon the laterally extending flat end surfaces 52 of the base portion 18 of the cutter housing which form the first portion of the track means 56. The roller bearing 80 is not mounted to the cam shaft 74 but rather is freely rotatable about the cam shaft 74. The roller bearing 80 is coaxially disposed about the cam shaft 74, rather than being disposed eccentrically about the cam shaft 74 as are the block 72 and bushing 76. Therefore, the roller bearing does not change its position upon rotation of the cam shaft 74 but rather remains resting upon the laterally extending upper surface 52 along the edge of the baseportion 18 of the cutter housing.

To gain access to the working chamber 16 of the rotary cutting apparatus 10, a workman must first remove the holddown belts 82 which serve to hold the laterally extending side flanges of the cover portion 20 of the cutter housing in mating relationship with the base portion 18 of the cutter housing. After removal of the bolts, a wrench is placed on the outwardly extending portion of the cam shaft 74 and the cam shaft is rotated until the stop means 78 contacts the upper surface 68 of the outwardly extending side flange 66 of the cover portion 18 to which the block 72 is mounted thereby raising the cover portion 20 of the cutter housing from the base portion 18 of the cutter housing as shown in FIG. 6B. After all four camrolls have been adjusted so as to raise each corner of the cover portion 20 of the cutter housing off the base portion 18 of the cutter housing, the cover portion 20 may be readily translated by rolling the cover portion 20 on roller bearings 80 along the track means 56 axially parallel to the longitudinal axis of the rotor shaft 14 on to the laterally spaced rails 54 forming the second portion of the track means 56 extending beyond the end of the base portion 18 of the cutter housing so as to expose the working chamber 18 to provide access to the horizontal rotor 12 disposed therein.

To replace the cover portion 20, the process is simply reversed with the cover portion 20 being rolled along the track means 56 back onto the base portion 18 of the cutter housing to again cover the working chamber 16. Once properly positioned on the base portion 18, each of the camrolls are again adjusted by rotating each cam shaft back to its original position thereby lowering the cover portion 20 of the cutter housing back on to the base portion 18 of the cutter housing so that the holddown belts 82 may be inserted and tightened to lock the cover portion 20 in mating relationship with the base portion 18 of the cutter housing again closing the working chamber 16 of the rotary cutter apparatus 10.

While the present invention has been described and illustrated as applied to provide an improved rotary cutting apparatus, it should be understood that application of the roll-top cover combination of the present invention to many other machines will be apparent to those of ordinary skill in the art. Accordingly, the present invention is intended to cover such applications as fall within the spirit and the scope of the appended claims.

I claim:

1. An improved rotary cutting apparatus comprising: a housing having a base portion and a cover portion disposed above the base portion so as to define a working chamber therebetween, the cover portion having laterally extending side flanges adapted to mate with the base portion; a generally cylindrical rotor mounted to a shaft disposed within the working chamber adapted for rotating about its longitudinal axis; at least one rotor knife peripherally fixed to the rotor; at least one bed knife fixedly mounted in the working chamber in cutting relationship with said at least one rotor knife; and inlet means mounted to the cover portion of the housing for feeding a material to be shredded into the working chamber; the improvement in said rotary cutting apparatus comprising:

a. a plurality of camroll means mounted to the cover portion of the housing along the lateral side flanges thereof for raising the cover portion of the housing off the base portion of the housing and for translating the cover portion of the housing parallel to the longitudinal axis of the rotor, each of said camroll means comprising a block mounted to the cover portion of the housing, a cam shaft extending axially through said block, said block disposed eccentrically about said cam shaft, a roller bearing disposed axially outwardly of said block and coaxially about said cam shaft so as to freely rotate about said cam shaft, an eccentric bushing mounted about said cam shaft intermediate said cam shaft and said block disposed eccentrically about said cam shaft whereby rotation of said cam bushing upon rotation of said cam shaft raises or lowers the cover portion of the housing relative to the base portion thereof, and stop means mounted to said cam shaft coaxially inwardly of said block for limiting the rotation of said cam shaft; and b. track means associated with the base portion of the housing along which the top portion of the housing may be translated on said camroll means, said track means having a first track portion comprising a lateral extending flat upper surface on each side of the base portion of the housing and a second track portion comprising a pair of laterally spaced rails extending axially outwardly from an end of the base portion of the housing, said rails positioned to receive the cover portion of the housing when the cover portion has been translated along the first track portion of said track means thereby opening the working chamber for access.

2. A rotary cutting apparatus as recited in claim 1 wherein said second track portion comprises:

a. a pair of laterally spaced rails interconnected by a support member extending transversely therebetween, said rails hinged to the end of the base portion of the housing so as to be selectively positionable from a first position extending substantially vertically downward along the end of the base portion of the housing to a second position extending axially outwardly from the end of the base portion of the housing whereby the rails form an extension of the flat upper surface at the sides of the base portion of the housing; and b. locking means operatively associated with said second track portion for locking the spaced rails in their section position when the locking means is engaged.

3. An improved working apparatus comprising: a housing have a base portion and a cover portion disposed above the base portion so as to define a working chamber therebetween having a longitudinal axis, the cover portion having laterally extending side flanges adapted to mate with the base portion; the improvement in said working apparatus comprising:

a. a plurality of camroll means mounted to the cover portion of the housing along the lateral side flanges thereof for raising the cover portion of the housing off the base portion of the housing and for translating the cover portion of the housing parallel to the longitudinal axis of the working chamber, each of said camroll means comprising a block mounted to the cover portion of the housing, a cam shaft extending axially through said block, said block disposed eccentrically about said cam shaft, a roller bearing disposed axially outwardly of said block and coaxially about said cam shaft so as to freely rotate about said cam shaft, an eccentric bushing mounted about said cam shaft intermediate said cam shaft and said block disposed eccentrically about said cam shaft whereby rotation of said cam bushing upon rotation of said cam shaft raises or lowers the cover portion of the housing relative to the base portion thereof, and stop means mounted to said cam shaft coaxially inwardly of said block for limiting the rotation of said cam shaft; and b. track means associated with the base portion of the housing along which the top portion of the housing may be translated on said camroll means, said track means having a first track portion comprising a lateral extending flat upper surface on each side of the base portion of the housing and a second track portion comprising a pair of laterally spaced rails extending axially outwardly from an end of the base portion of the housing, said rails positioned to receive the cover portion of the housing when the cover portion has been translated along the first track portion of said track means thereby opening the working chamber for access.

4. A working apparatus as recited in claim 3 wherein said second track portion comprises:

a. a pair of laterally spaced rails interconnected by a support member extending transversely therebetween, said rails hinged to the end of the base portion of the housing so as to be selectively positionable from a first position extending substantially vertically downward along the end of the base portion of the housing to a second position extending axially outwardly from the endo of the base portion of the housing whereby the rails form an extension of the flat upper surface at the sides of the base portion of the housing; and b. locking means operatively associated with said second track portion for locking the spaced rails in their section position when the locking means is engaged.

* * * * *